US006070535A

United States Patent [19]

Johnson

[11] Patent Number: 6,070,535

[45] Date of Patent: Jun. 6, 2000

[54] PLASTIC PALLET

[76] Inventor: Scott H. Johnson, 1305 Espejo NE., Albequerque, N.Mex. 87112

[21] Appl. No.: 09/295,670

[22] Filed: Apr. 21, 1999

[51] Int. Cl.[7] ..... B65D 19/38

[52] U.S. Cl. ..... 108/55.5; 108/901; 108/57.28

[58] Field of Search ..... 108/57.25, 57.16, 108/57.28, 55.1, 55.3, 55.5, 901

[56] References Cited

U.S. PATENT DOCUMENTS

| | | | |
|---|---|---|---|
| 2,614,689 | 10/1952 | Miller | 108/55.5 X |
| 3,472,363 | 10/1969 | Rustin, Jr. et al. | 108/55.1 X |
| 3,524,415 | 8/1970 | Heiman | 108/55.1 X |
| 3,795,206 | 3/1974 | Utz | 108/57.28 |
| 3,910,204 | 10/1975 | Jesse | 108/57.28 X |
| 3,951,078 | 4/1976 | Fowler et al. | 108/57.28 |
| 4,580,680 | 4/1986 | Wind | 108/55.3 X |
| 4,597,338 | 7/1986 | Kreeger . | |
| 4,809,617 | 3/1989 | Bell . | |
| 5,086,927 | 2/1992 | Bach et al. | 108/55.5 X |
| 5,197,395 | 3/1993 | Pigott et al. . | |
| 5,402,735 | 4/1995 | DeJean . | |
| 5,445,084 | 8/1995 | Durand . | |
| 5,456,189 | 10/1995 | Belle Isle . | |
| 5,476,048 | 12/1995 | Yamashita et al. . | |
| 5,497,709 | 3/1996 | Gonzalez et al. . | |
| 5,505,141 | 4/1996 | Barber . | |
| 5,555,820 | 9/1996 | Shuert . | |
| 5,579,701 | 12/1996 | Fook Wah . | |
| 5,687,652 | 11/1997 | Ruma . | |

FOREIGN PATENT DOCUMENTS

| | | | |
|---|---|---|---|
| 2283058 | 3/1976 | France | 108/55.1 |
| 1268059 | 5/1968 | Germany | 108/55.3 |

*Primary Examiner*—Peter M. Cuomo
*Assistant Examiner*—Hanh V. Tran
*Attorney, Agent, or Firm*—Kenneth L Tolar

[57] ABSTRACT

A plastic pallet includes a substantially rectangular platform section having an upper surface and four side walls depending therefrom. The pallet also includes a lower support section for suspending the platform section a predetermined distance above the ground. The support section includes four edges each having an inwardly angled portion and a vertical portion. A first pair of channels extend from a first edge to an opposing second edge. A second pair of channels extend from a third edge to an opposing fourth edge, each channel dimensioned to receive a forklift blade. The support structure also includes two sets of slots, each set substantially perpendicular to the other and extending from one edge of the support section to an opposing edge for receiving binding straps to restrain items resting on the pallet. The slots are disposed above the channels and are segregated such that the straps do not interfere with the forklift blades or each other.

2 Claims, 2 Drawing Sheets

PLASTIC PALLET

BACKGROUND OF THE INVENTION

The present invention relates to a plastic pallet having segregated strap receiving channels allowing items resting on the pallet to be secured thereto.

DESCRIPTION OF THE PRIOR ART

Heavy items are often stacked on wooden pallets so that a forklift can lift the entire stack including the pallet to relocate or load the items onto a vehicle. Over time, the wooden pallets deteriorate requiring frequent replacement. Therefore, the use of such wooden pallets results in significant consumption of timber. Furthermore, when items are stacked on pallets, they tend to fall off the pallet resulting in significant clutter and mess. In such case, the items must be periodically restacked which is laborious and inconvenient. The present invention overcomes the deficiencies of conventional pallets by providing a plastic pallet including means for supporting a plurality of binding straps to securely retain items thereon. Although at least one plastic pallet designed to receive binding straps exists in the prior art, the straps are susceptible to entangling and may interfere with the forklift blades.

Various plastic pallets exist in the prior art. For example, U.S. Pat. No. 5,687,652 issued to Ruma relates to a plastic four-way entry pallet.

U.S. Pat. No. 5,579,701 issued to Fook Wah relates to a knock down plastic pallet and method of manufacturing the same.

U.S. Pat. No. 5,555,820 issued to Shuert relates to a plastic pallet having an upper platform and a plurality of plastic legs attached to and extending downward from the underside thereof.

U.S. Pat. No. 5,505,141 issued to Barber relates to a plastic pallet formed of two identical interlocking and mating components joined along a common center plane. The device includes tie down strap passages. However, the passages are disposed such that intersecting straps will interfere with each other. In addition, the straps are positioned within the forklift blade passages such that they can interfere with the blades as well.

U.S. Pat. No. 5,497,709 issued to Gonzalez et al relates to a plastic pallet assembly.

U.S. Pat. No. 5,476,048 issued to Yamashita et al relates to a pallet for storage and transportation of goods including a single frame work molded from plastic having a hollow interior filled with a refrigerant.

Although various plastic pallet constructions exist in the prior art, none include means for supporting segregated binding straps that allow items resting on the pallet to be strapped thereto. The device is specifically designed such that the straps will not interfere with forklift blades or each other.

SUMMARY OF THE INVENTION

The present invention relates to a unitary plastic pallet comprising an upper platform section and a lower support section. The support section including two pairs of intersecting channels, each dimensioned to receive a forklift blade allowing the pallet to be easily lifted with a forklift from either of the four sides. The pallet also includes two sets of slots extending from each side of the pallet to the opposing side, each for receiving a binding strap. Therefore, the straps may be used to securely bind and retain items on the pallet. It is therefore an object of the present invention to provide a pallet constructed with a durable, reusable material.

It is another object of the present invention to provide a pallet having means for securing binding straps thereto.

It is yet another object of the present invention to provide a pallet having means for securing binding straps thereto so that the straps do not become entangled or interfere with the forklift blades. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
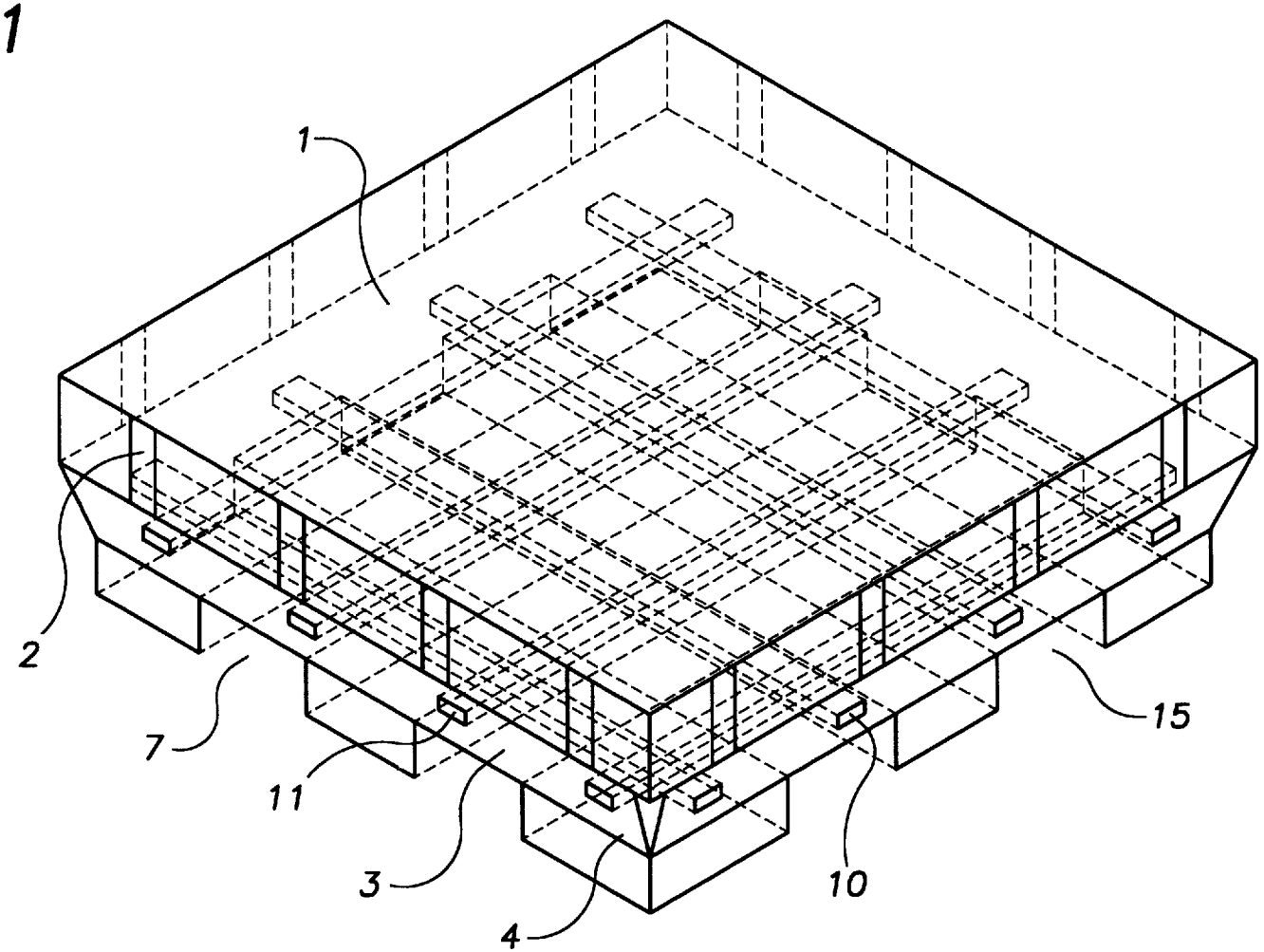
FIG. 1 is a perspective view of the pallet according to the present invention.
Figure 2:
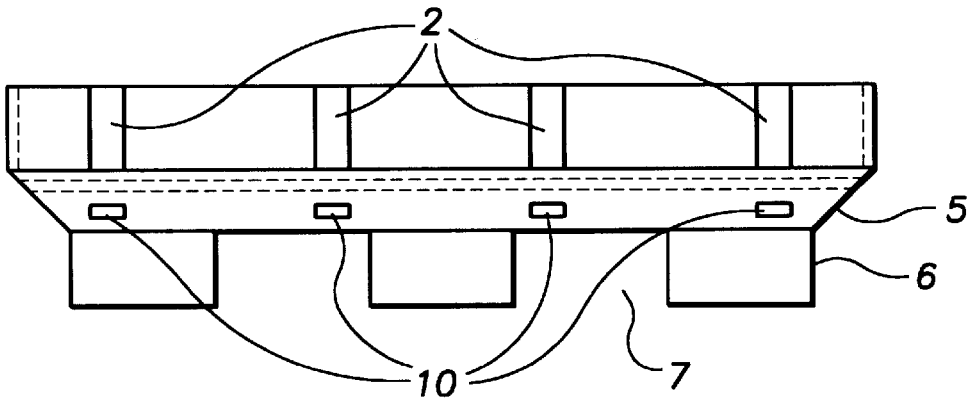
FIG. 2 is a side view of the pallet according to the present invention.
Figure 3:
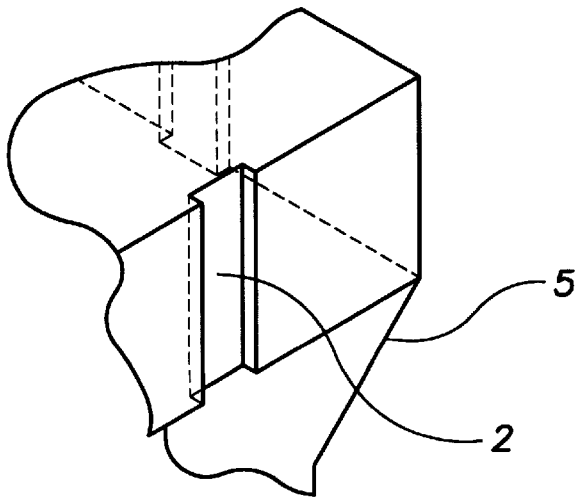
FIG. 3 is a detailed view of a strap supporting notch according to the present invention.

Referring now to FIGS. 1 through 3, the present invention relates to a unitary plastic pallet including a substantially square or rectangular platform section 1 having an upper surface and four side walls depending therefrom. Each side wall of the platform section includes a plurality of parallel vertical spaced notches 2 for receiving a section of a binding strap as will be described in more detail below. The pallet also includes a lower support section 3 which suspends the platform a predetermined distance above the ground. The support section includes four peripheral edges 4 each including an oblique portion 5 that angles inwardly towards the center of the platform section and a vertical portion 6 depending therefrom. The vertical portion includes a first set of channels 7 extending from one edge to the opposing edge and a second set of channels 15 extending from a third edge to the opposing fourth edge. The first and second sets of channels intersect and each is dimensioned to receive a forklift blade. Such a construction allows the pallet to be lifted with a forklift approaching from either of the four sides thereof.

The support structure further includes a first set of slots 10 extending from the angled portion of a first edge to the angled portion of an opposing second edge. The support section also includes a second set of slots 11 extending from the angled portion of a third edge to the angled portion of the opposing fourth edge. The first and second sets of slots are generally perpendicular to each other and are disposed above the channels so as to not interfere with the forklift blades. In addition, the first set is disposed above the second set and each slot is segregated from each of the others so that multiple straps may be used in a criss-cross fashion without the straps interfering with each other. The slots each receive binding straps (not pictured) for restraining items resting on the upper surface of the platform.

To use the above described device, items are stacked on the upper surface of the support platform. The straps received within the elongated slots are wrapped about the stacked items and are joined. Preferably a portion of each strap is disposed within a notch thereby preventing the straps from shifting or sliding. The pallet may be lifted with a forklift approaching from either of the four sides by inserting the forklift blades into a pair of parallel channels.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pallet comprising:

a top platform section having an upper surface and four sidewalls depending therefrom;

a lower support section beneath said top platform section for supporting said platform a predetermined distance above the ground, said support section including four peripheral edges and a plurality of segregated slots, each slot extending from one edge to an opposing edge, each of said slots for receiving a strap to bind items resting on the upper surface of said platform section;

said support section peripheral edges each include an inwardly angled portion and a vertical portion;

said support section further including first and second sets of channels, with the first set extending from the vertical portion of a first edge to the vertical portion of a second opposing edge, and the second set extending from the vertical portion of a third edge to the vertical portion of an opposing fourth edge, each of said channels dimensioned to receive a forklift blade, said first and second sets of channels intersecting whereby a pair of forklift blades can be inserted beneath any of said edges;

said slots are arranged in two sets, with a first set disposed above and substantially perpendicular to a second set, said first set extending from the angled portion of one edge of the support section to the angled portion of an opposing edge, the second set extending from the angled portion of a third edge to the angled portion of fourth opposing edge, said first and second sets of slots disposed above said channels.

2. A pallet according to claim 1 wherein said platform further comprises:

a plurality of parallel spaced vertical notches on each of said side walls for receiving a portion of said strap when said strap is wrapped about items resting on said platform to prevent said straps from shifting.

* * * * *